US009670659B2

(12) United States Patent
Kang et al.

(10) Patent No.: US 9,670,659 B2
(45) Date of Patent: Jun. 6, 2017

(54) NOZZLE ASSEMBLY AND BIDET INCLUDING SAME

(71) Applicant: COWAY CO., LTD., Chungcheongnam-do (KR)

(72) Inventors: Hee-Ju Kang, Seoul (KR); Man-Uk Park, Seoul (KR); Sung-Worl Jin, Seoul (KR); Da-Woon Jung, Seoul (KR); Young-Pyo Kim, Seoul (KR)

(73) Assignee: COWAY CO., LTD., Chungcheongnam-do (KR)

( * ) Notice: Subject to any disclaimer, the term of this patent is extended or adjusted under 35 U.S.C. 154(b) by 0 days.

(21) Appl. No.: 14/878,314

(22) PCT Filed: Apr. 16, 2014

(86) PCT No.: PCT/KR2014/003297
§ 371 (c)(1),
(2) Date: Oct. 8, 2015

(87) PCT Pub. No.: WO2014/178551
PCT Pub. Date: Nov. 6, 2014

(65) Prior Publication Data

US 2016/0076236 A1 Mar. 17, 2016

(30) Foreign Application Priority Data

Apr. 30, 2013 (KR) ..... 10-2013-0048411
Dec. 2, 2013 (KR) ..... 10-2013-0148684
Mar. 31, 2014 (KR) ..... 10-2014-0037582

(51) Int. Cl.
*A47K 3/022* (2006.01)
*E03D 9/08* (2006.01)

(52) U.S. Cl.
CPC ..... *E03D 9/08* (2013.01); *A47K 3/022* (2013.01)

(58) Field of Classification Search
CPC ..... E03D 9/08
USPC ..... 4/443–448
See application file for complete search history.

(56) References Cited

U.S. PATENT DOCUMENTS 4,242,764 A 1/1981 Fukuda
2003/0140407 A1 7/2003 Matsumoto et al.

FOREIGN PATENT DOCUMENTS

| | | |
|---|---|---|
| AT | 354606 | 1/1979 |
| CA | 2249806 | 4/2000 |
| CN | 1432354 | 7/2003 |
| EP | 0275492 | 7/1988 |

(Continued)

OTHER PUBLICATIONS

State Intellectual Property Office of China Chinese Office Action, dated Aug. 12, 2016. (9 pages).

*Primary Examiner* — Lori Baker
(74) *Attorney, Agent, or Firm* — Dority & Manning, P.A.

(57) ABSTRACT

A nozzle assembly and a bidet including the same are provided. The nozzle assembly may include a plurality of sitz bath nozzles dispensing jets of water, wherein a plurality of water streams formed by the jets of water dispensed by the plurality of sitz bath nozzles contact each other at a water contact point to form fountain-like water streams. Thus, a clinical effect of the sitz bath is brought about as the pressure inside the anus is reduced. In addition, secondary diseases such as the urinary tract infection and the like for female users may be prevented, and the stress exerted to the anus at the beginning of the sitz bath function may be significantly decreased.

20 Claims, 6 Drawing Sheets

(56) References Cited

FOREIGN PATENT DOCUMENTS

| | | |
|---|---|---|
| EP | 1247911 | 10/2002 |
| JP | 58-135240 | 8/1983 |
| JP | 02-080725 | 3/1990 |
| JP | 08-246536 | 9/1996 |
| JP | 2002021152 | 1/2002 |
| JP | 2005194858 | 7/2005 |
| JP | 2012-107476 | 6/2012 |
| KR | 2005-0033666 | 6/2006 |
| KR | 20110105246 | 9/2011 |
| WO | WO 0120084 | 3/2001 |

NOZZLE ASSEMBLY AND BIDET INCLUDING SAME

CROSS REFERENCE TO RELATED APPLICATIONS

This application is the U.S. National Stage entry of International Application Number PCT/KR2014/003297 filed under the Patent Cooperation Treaty having a filing date of Apr. 16, 2014, which claims priority to Korean Patent Application Serial Number 10-2013-0048411, having a filing date of Apr. 30, 2013, Korean Patent Application Serial Number 10-2013-0148684, having a filing date of Dec. 2, 2013, and Korean Patent Application Serial Number 10-2014-0037582, having a filing date of Mar. 31, 2014, the disclosure of all of which are hereby incorporated by reference herein in their entirety for all purposes.

TECHNICAL FIELD

The present disclosure relates to a nozzle assembly and a bidet including the same, and more particularly, to a nozzle assembly having a plurality of nozzles dispensing jets of water, which contact each other and form fountain-like water streams, and a bidet including the same.

BACKGROUND ART

In general, a sitz bath is used after users get treatments and/or surgeries to treat hemorrhoids and the like, in order to relieve stress on their anus.

In many cases, the sitz bath is used when users have limited mobility. Thus, various kinds of sitz baths have been developed for user convenience.

In addition, such a sitz bath is usually used in bathrooms due to a characteristic thereof. Thus, a technology adding sitz bath functions to a bidet installed in a toilet seat to wash the genitals and anus after the user relieves himself or herself has been developed for efficient use of space.

When the functions of the sitz bath are added to a bidet, an effect of sitz bath may be achieved as a nozzle included in the bidet dispenses a jet of water.

However, high pressure of water dispensed by a nozzle in a linear manner may make the anus contract and increase pressure inside the anus in the short term, thereby having harmful effects on the anus.

In particular, when the linear water stream suddenly touches the anus at the beginning of the sitz bath function, the anus may suddenly contract. Such a problem is most severe at the beginning of the sitz bath function.

Further, as illustrated in FIG. 1, a general nozzle 1 included in a bidet may be installed to be forwardly inclined from below and to the rear of the genitals and anus C of the user, to dispense a jet of water. Thus, when a female user uses a sitz bath, a secondary infection such as a urinary tract infection and the like may be caused.

DISCLOSURE

Technical Problem

An aspect of the present disclosure provides a nozzle assembly having a plurality of nozzles dispensing jets of water, which contact each other and form fountain-like water streams, and thus pressure inside the anus of users may be reduced when the users use the sitz bath, and a bidet including the same.

Technical Solution

According to an aspect of the present disclosure, a nozzle assembly may include a plurality of sitz bath nozzles dispensing jets of water, wherein a plurality of water streams formed by the jets of water dispensed by the plurality of sitz bath nozzles may contact each other at a water contact point to form fountain-like water streams.

In the nozzle assembly according to an aspect of the present disclosure, the water contact point may be positioned above the plurality of sitz bath nozzles.

In the nozzle assembly according to an aspect of the present disclosure, the water contact point may be formed at the apex point of the plurality of water streams or at a point at which the plurality of water streams fall downwardly after reaching the apex point.

In the nozzle assembly according to an aspect of the present disclosure, the plurality of sitz bath nozzles and the water contact point may be positioned on a single virtual plane.

In the nozzle assembly according to an aspect of the present disclosure, the virtual plane may be perpendicular to a horizontal plane.

In the nozzle assembly according to an aspect of the present disclosure, the plurality of sitz bath nozzles may be provided as a pair of sitz bath nozzles, respectively included in each of a pair of sitz bath cylinders.

In the nozzle assembly according to an aspect of the present disclosure, the virtual plane on which the pair of sitz bath nozzles and the water contact point are positioned may be perpendicular to a horizontal plane.

In the nozzle assembly according to an aspect of the present disclosure, the water streams dispensed by the pair of sitz bath nozzles may have equal water jet angles with respect to an axis perpendicular to a horizontal plane.

In the nozzle assembly according to an aspect of the present disclosure, the water jet angles may range from 2.5 to 3.5 degrees.

In the nozzle assembly according to an aspect of the present disclosure, the pair of sitz bath cylinders may be disposed to be spaced apart from each other by 45 mm to 55 mm.

In the nozzle assembly according to an aspect of the present disclosure, the pair of sitz bath nozzles may respectively dispense 0.4 to 1.6 liters of water per minute.

In the nozzle assembly according to an aspect of the present disclosure, the plurality of sitz bath nozzles may be included in a single sitz bath cylinder.

The nozzle assembly according to an aspect of the present disclosure may further include a spray nozzle formed in the sitz bath cylinder to form spray water streams.

In the nozzle assembly according to an aspect of the present disclosure, the spray nozzle may be formed between the plurality of sitz bath nozzles.

In the nozzle assembly according to an aspect of the present disclosure, the plurality of sitz bath nozzles may be formed in the sitz bath cylinder in a length direction thereof to be spaced apart from each other.

In the nozzle assembly according to an aspect of the present disclosure, the plurality of sitz bath nozzles may include a first sitz bath nozzle formed in the sitz bath cylinder and a second sitz bath nozzle formed in the sitz bath cylinder to be spaced from the first sitz bath nozzle in a rearward direction.

In the nozzle assembly according to an aspect of the present disclosure, the first sitz bath nozzle may dispense water in a direction of the second sitz bath nozzle, and an angle formed by the dispensed water with respect to a plane of the sitz bath cylinder may be in a rage of 60 to 80 degrees. The second sitz bath nozzle may dispense water so that the water may contact a water stream formed by the water dispensed by the first sitz bath nozzle at the water contact point.

The nozzle assembly according to an aspect of the present disclosure may further include a cleansing cylinder dispensing water to the genitals and anus of the user.

A bidet according to an aspect of the present disclosure may include the nozzle assembly, a stream path changing device able to determine a cylinder to dispense water among the sitz bath cylinder and the cleansing cylinder, and a control unit controlling the stream path changing device.

In the bidet according to an aspect of the present disclosure, the nozzle assembly may further include a spray nozzle forming spray water streams. The stream path changing device may determine a nozzle to dispense water among the sitz bath nozzle and the spray nozzle.

In the bidet according to an aspect of the present disclosure, when a user selects a sitz bath function, the control unit may control the stream path changing device so that water is dispensed through the spray nozzle at an early stage of the sitz bath function, and when a predetermined time passes, the control unit may control the stream path changing device so that water is dispensed through the sitz bath nozzle.

Advantageous Effects

According to an aspect of the present disclosure, a nozzle assembly and a bidet including the same may reduce the pressure inside the anus when a user uses a sitz bath and have a clinical effect.

In addition, according to an aspect of the present disclosure, the nozzle assembly and the bidet including the same may prevent a secondary disease such as a urinary tract infection and the like for female users.

Further, according to an aspect of the present disclosure, the nozzle assembly and the bidet including the same may relieve stress on the anus of the user at the beginning of the sitz bath function.

BEST MODE

Hereinafter, embodiments of the present disclosure will be described in detail with reference to the accompanying drawings.

FIGS. 2A through 2E are conceptual views illustrating a position of a sitz bath nozzle dispensing water and water streams dispensed by the sitz bath nozzles in a nozzle assembly 100 according to an exemplary embodiment of the present disclosure.

Figure 1:
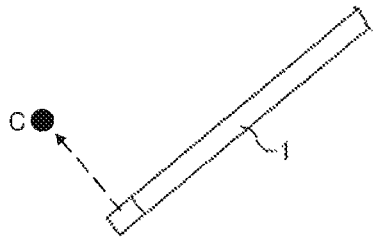
FIG. 1 is a side view schematically illustrating a direction of water dispensed by a bidet nozzle according to the related art.
Figure 2A:
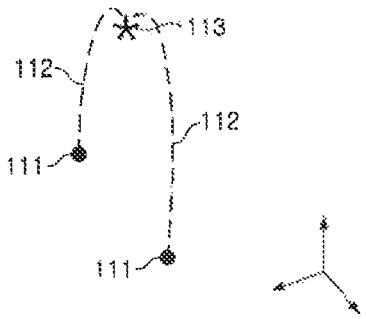
FIG. 2 is a conceptual view illustrating a position of a sitz bath nozzle and a direction of water dispensed by the sitz bath nozzle.
Figure 2B:
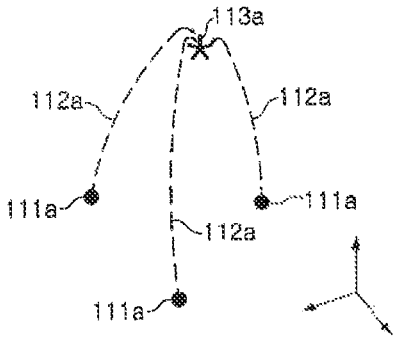
Figure 2C:
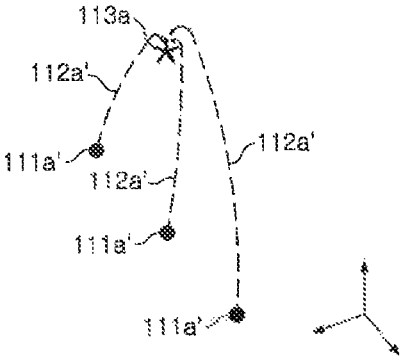
Figure 2D:
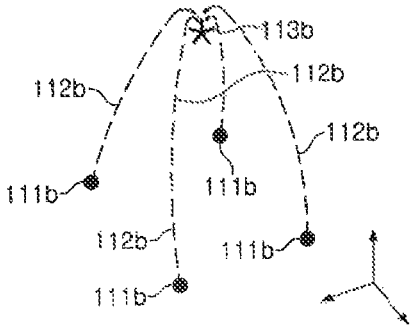
Figure 2E:
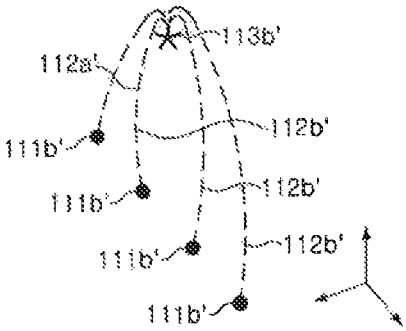

FIG. 2A illustrates a case in which two sitz bath nozzles are included in the nozzle assembly 100. FIGS. 2B and 2C illustrate cases in which three sitz bath nozzles are included in the nozzle assembly 100. FIGS. 2D and 2E illustrate cases in which four sitz bath nozzles are included in the nozzle assembly 100.

Referring to FIGS. 2A through 2E, the nozzle assembly 100 according to the exemplary embodiment of the present disclosure may include a plurality of sitz bath nozzles 111, 111*a*, 111*a*', 111*b*, 111*b*' dispensing water.

The water dispensed by the sitz bath nozzles 111, 111*a*, 111*a*', 111*b*, 111*b*' may form respective water streams 112, 112*a*, 112*a*', 112*b*, 112*b*'. Here, the respective water streams 112, 112*a*, 112*a*', 112*b*, 112*b*' may contact each other at a water contact point 113, 113*a*, 113*a*', 113*b*, 113*b*', and thus power of the respective water streams 112, 112*a*, 112*a*', 112*b*, 112*b*' may be offset. Accordingly, a fountain-like water stream (not illustrated) may be formed.

A clinical effect of the sitz bath may be brought about as the anus of a user contacts the fountain-like water stream (not illustrated). In addition, since the water is not directly dispensed to the anus, stimulation to the anus may be significantly reduced, and stress on the anus may not occur, and thus pressure inside the anus may be decreased.

Here, the water streams 112, 112*a*, 112*a*', 112*b*, 112*b*' may make a parabola due to gravity, and the water contact point 113, 113*a*, 113*a*', 113*b*, 113*b*' may be positioned at the apex point of the parabola formed by the water streams 112, 112*a*, 112*a*', 112*b*, 112*b*'.

In addition, the water contact point 113, 113*a*, 113*a*', 113*b*, 113*b*' may be positioned at a point of the parabola formed by the water streams 112, 112*a*, 112*a*', 112*b*, 112*b*' after reaching the apex point. In other words, the water contact point 113, 113*a*, 113*a*', 113*b*, 113*b*' may be positioned at a point at which the water streams 112, 112*a*, 112*a*', 112*b*, 112*b*' fall downwardly.

Thus, the fountain-like water stream (not illustrated) may have faint upward power, and thus, the pressure exerted to the anus may be significantly reduced, and the stress on the anus may also be significantly decreased.

In the exemplary embodiment of the present disclosure, a case in which the fountain-like water stream formed at the water contact point 113, 113*a*, 113*a*', 113*b*, 113*b*' is used for sitz bath is described by way of example, but the use of the fountain-like water stream is not limited thereto, and the fountain-like water stream formed at the water contact point 113, 113*a*, 113*a*', 113*b*, 113*b*' may be used to wash affected areas.

The water contact point 113, 113*a*, 113*a*', 113*b*, 113*b*' may be formed above the sitz bath nozzles 111, 111*a*, 111*a*', 111*b*, 111*b*'.

In addition, as illustrated in FIGS. 2A, 2C, and 2E, the sitz bath nozzles 111, 111*a*, 111*a*', 111*b*, 111*b*' and the water contact point 113, 113*a*, 113*a*', 113*b*, 113*b*' may be positioned in a single virtual plane, wherein the virtual plane may be perpendicular to a horizontal plane.

Accordingly, unlike a general bidet nozzle in which water is dispensed in a forward direction of a user, the nozzle assembly 100 may not allow the water used in the sitz bath function to move in a forward direction of the human body, so as to prevent secondary diseases such as a urinary tract infection and the like for female users.

Hereinbefore, cases in which two to four sitz bath nozzles are included in a nozzle assembly have been described, but as long as a fountain-like water stream is formed by forming a plurality of water streams to contact each other at a water contact point, the numbers and positions of the sitz bath nozzles and directions of the water streams may not be limited thereto.

However, the nozzle assembly may desirably include a pair of sitz bath nozzles.

First Exemplary Embodiment of the Present Disclosure

Hereinafter, a nozzle assembly 100 according to the first exemplary embodiment of the present disclosure may be described in detail.

Figure 3:
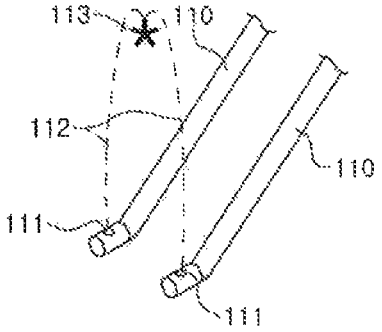
FIG. 3 is a perspective view schematically illustrating a nozzle assembly according to the first exemplary embodiment of the present disclosure.
Figure 4:
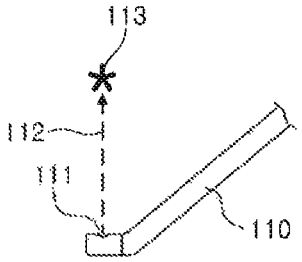
FIG. 4 is a side view schematically illustrating the nozzle assembly according to the first exemplary embodiment of the present disclosure.
Figure 5:
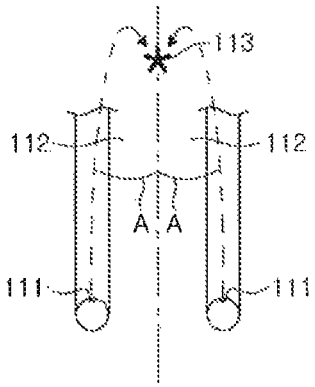
FIG. 5 is a front view schematically illustrating the nozzle assembly according to the first exemplary embodiment of the present disclosure.

FIGS. 3 through 5 are respectively a perspective view, a side view, and a front view, schematically illustrating the nozzle assembly 100 according to the first exemplary embodiment of the present disclosure.

Referring to FIGS. 3 through 5, the nozzle assembly 100 according to the first exemplary embodiment of the present disclosure may include a pair of sitz bath cylinders including sitz bath nozzles 111 and 111' to dispense water.

The water dispensed by the sitz bath nozzles 111 and 111' may respectively form water streams 112 and 112'. Here, as the water streams 112 and 112' may contact each other at a water contact point 113 positioned above the sitz bath nozzles 111 and 111', the power of the water streams 112 and 112' may be offset. Accordingly, a fountain-like water stream (not illustrated) may be formed.

A clinical effect of a sitz bath may be brought about as the anus of the user contacts the fountain-like water stream (not illustrated). In addition, since water is not dispensed directly to the anus, stimulation to the anus may be significantly reduced, and stress on the anus may not occur, such that pressure inside the anus may be decreased.

Here, the water streams 112 and 112' may make a parabola due to the gravity, and the water contact point may be positioned at the apex point of the parabola formed by the water streams 112 and 112'.

In addition, the water contact point 113 may be positioned at a point of the parabola formed by the water streams 112 and 112' after reaching the apex point. In other words, the water contact point 113 may be positioned at a point at which the water streams 112 and 112' fall downwardly.

Thus, the fountain-like water stream (not illustrated) may have faint upward power, and thus, the pressure exerted to the anus may be significantly reduced, and the stress on the anus may also be significantly decreased.

In the first exemplary embodiment of the present disclosure, a case in which the fountain-like water stream formed at the water contact point 113 is used for the sitz bath function is described by way of example, but the use of the fountain-like water stream is not limited thereto, and the fountain-like water stream formed at the water contact point 113 may be used to wash affected areas.

Here, a virtual plane on which the sitz bath nozzles 111 and 111' and the water contact point 113 are positioned may be perpendicular to a horizontal plane.

Accordingly, unlike a general bidet nozzle in which water is dispensed in a forward direction of a user, the nozzle assembly 100 may not allow the water used in the sitz baths to move in a forward direction of the human body, so as to prevent secondary diseases such as a urinary tract infection and the like for female users.

The water streams 112 and 112' may form equal water jet angles A to each other with respect to an axis perpendicular to a horizontal plane.

The water jet angle A may range from 2.5 to 3.5 degrees.

In addition, a pair of sitz bath cylinders 110 and 110' may be disposed to be spaced apart from each other by, desirably, 45 mm to 55 mm, to prevent the cylinders from being contaminated by excrement and the like during the sitz bath function.

The sitz bath nozzles 111 and 111' may respectively dispense 0.4 to 1.6 liters of water per minute to form relatively the most suitable sitz bath water streams.

Figure 6:
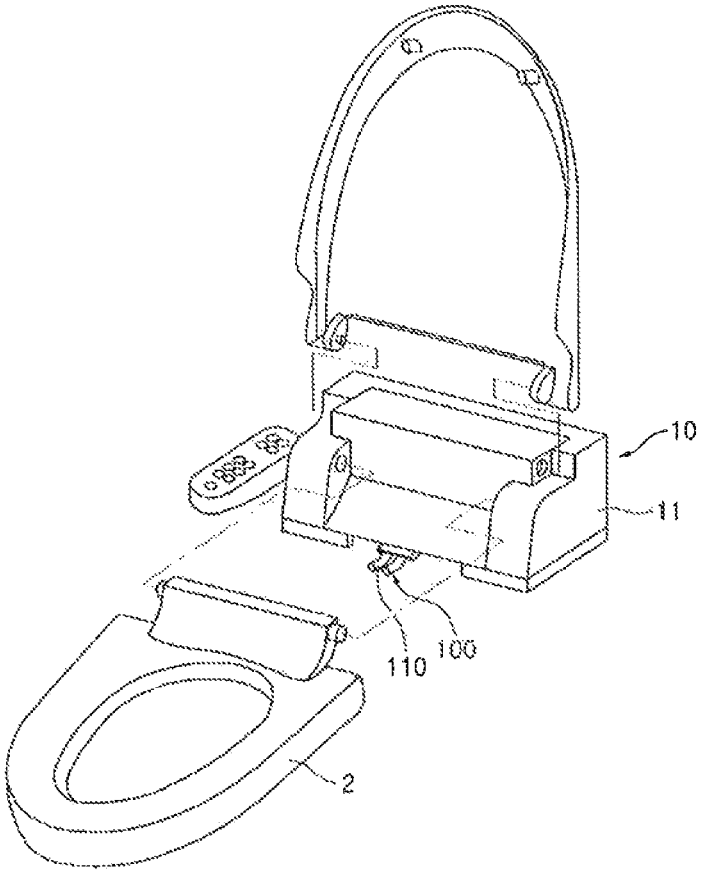
FIG. 6 is an exploded perspective view illustrating a bidet including the nozzle assembly according to the first exemplary embodiment of the present disclosure.

FIG. 6 is an exploded perspective view illustrating a bidet 10 including the nozzle assembly 100 according to the first exemplary embodiment of the present disclosure.

As illustrated in FIG. 6, the bidet 10 including the nozzle assembly 100 according to the first exemplary embodiment of the present disclosure may include a bidet body 11 installed to a rear of a toilet seat 2. The nozzle assembly 100 according to the first exemplary embodiment of the present disclosure may be installed in the bidet body 11.

Here, the nozzle assembly 100 may include a driving unit (not illustrated) so that the sitz bath cylinders 110 and 110' are drawn in or drawn out.

Second Exemplary Embodiment of the Present Disclosure

Hereinafter, a nozzle assembly 200 according to the second exemplary embodiment of the present disclosure may be described in detail.

Figure 7:
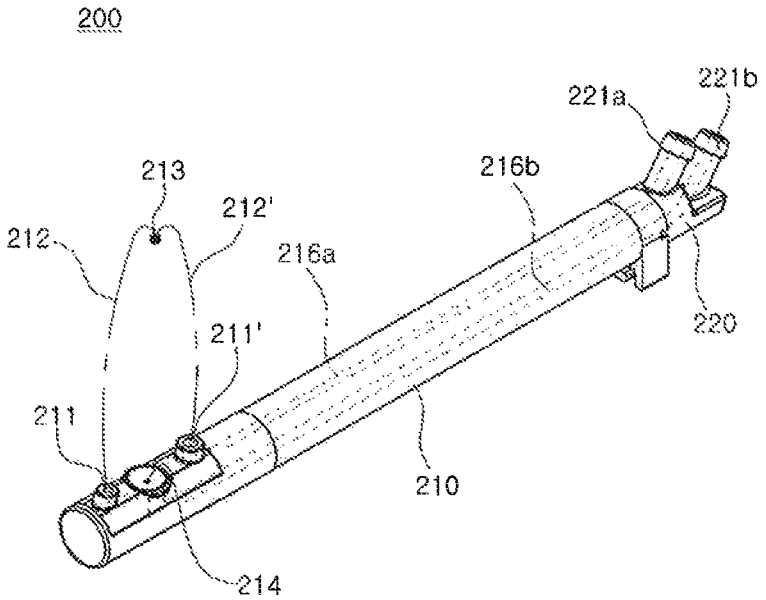
FIG. 7 is a perspective view illustrating a nozzle assembly according to the second exemplary embodiment of the present disclosure.
Figure 8:
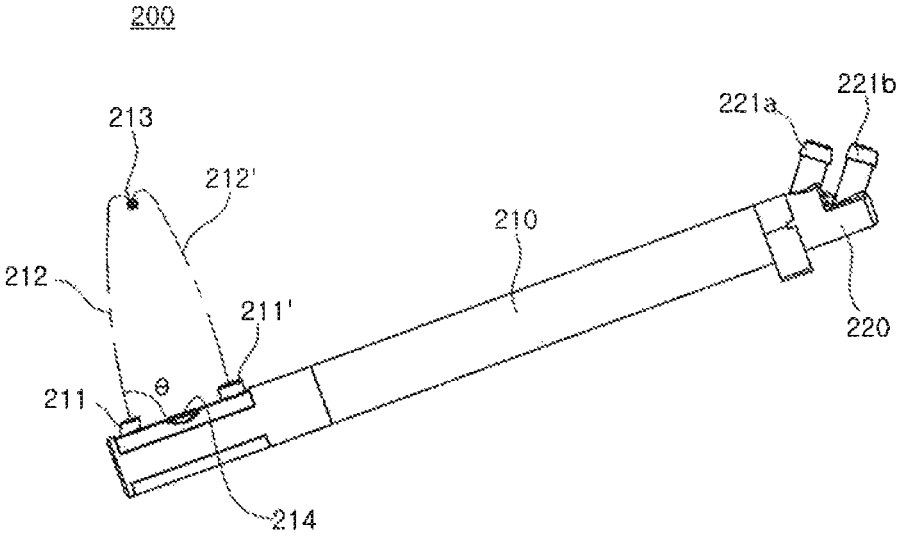
FIG. 8 is a side view illustrating a fountain-like water stream formed by the nozzle assembly according to the second exemplary embodiment of the present disclosure.
Figure 9:
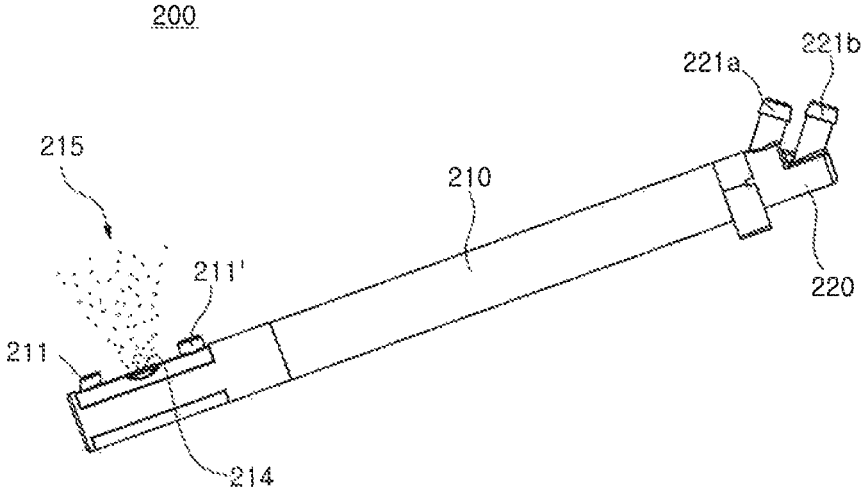
FIG. 9 is a side view illustrating a spray water stream formed by the nozzle assembly according to the second exemplary embodiment of the present disclosure.

FIG. 7 is a perspective view illustrating the nozzle assembly 200 according to the second exemplary embodiment of the present disclosure. FIG. 8 is a side view illustrating sitz bath water streams formed by the nozzle assembly 200 according to the second exemplary embodiment of the present disclosure. FIG. 9 is a side view illustrating a spray water stream formed by the nozzle assembly 200 according to the second exemplary embodiment of the present disclosure.

Referring to FIG. 7, the nozzle assembly 200 may include a sitz bath cylinder 210, first and second sitz bath nozzles 211 and 211' formed in the sitz bath cylinder 210, a spray nozzle 214, and a connector 220.

The sitz bath cylinder 210 may be formed to have a cylindrical shape in which first and second internal stream paths 216*a* and 216*b* respectively connected to the first and second sitz bath nozzles 211 and 211' and the spray nozzle 214 are formed.

In addition, the sitz bath cylinder 210 may be installed so as to be moved in front and rear directions thereof.

A plurality of sitz bath nozzles 211 and 211' may be installed in the sitz bath cylinder 210 to dispense water supplied through the first internal stream path 216*a* towards the human body.

Referring to FIG. 8, water streams 212 and 212' formed by the water dispensed by the plurality of sitz bath nozzles 211 and 211' may contact each other at a water contact point 213 to form a fountain-like water stream (not illustrated).

A clinical effect may be brought about as the anus of the user contacts the fountain-like water stream (not illustrated). In addition, since water is not dispensed directly to the anus, stimulation to the anus may be significantly reduced, and stress on the anus may not occur, and thus pressure inside the anus may be decreased.

Here, the water streams 212 and 212' may make a parabola due to the gravity, and the water contact point 213 may be positioned at the apex point of the parabola formed by the water streams 212 and 212'.

In addition, the water contact point 213 may be positioned at a point of the parabola formed by the water streams 212 and 212' after reaching the apex point. In other words, the water contact point 213 may be positioned at a point at which the water streams 212 and 212' fall downwardly.

Thus, the fountain-like water stream (not illustrated) may have faint upward power, and thus, the pressure exerted to the anus may be significantly reduced, and the stress on the anus may also be significantly decreased.

In the second exemplary embodiment of the present disclosure, a case in which the fountain-like water stream formed at the water contact point 213 is used for the sitz bath function is described by way of example, but the use of the fountain-like water stream is not limited thereto, and the fountain-like water stream formed at the water contact point 113 may be used to wash affected areas.

As illustrated in FIGS. 7 through 9, the plurality of sitz bath nozzles 211 and 211' may include two sitz bath nozzles, the first sitz bath nozzle 211 and the second sitz bath nozzle 211'. However, the number of the sitz bath nozzles 211 and 211' is not limited thereto, and three or more sitz bath nozzles may be included.

Here, the first sitz bath nozzle 211 and the second sitz bath nozzle 211' may be formed to be spaced apart from each other along a length direction of the sitz bath cylinder 210, and the second sitz bath nozzle 211' may be formed to be spaced rearwardly from the first sitz bath nozzle 211 along the length direction of the sitz bath cylinder 210.

An angle θ formed by the first water stream 212 formed by the water dispensed by the first sitz bath nozzle with respect to a plane of the sitz bath cylinder 210 may be in a range of 60 to 80 degrees. The second water stream 212' formed by the water dispensed by the second sitz bath nozzle 212' may meet the first water stream 212 at the water contact point 213. In this case, the second water stream 212' may be dispensed so as to make a right angle with respect to the length direction of the sitz bath cylinder 210 or a predetermined angle with respect to the sitz bath cylinder 210 other than the right angle.

As illustrated in FIG. 9, the spray nozzle 214 may be formed in the sitz bath cylinder 210 to form a spray water stream 215.

When the user selects a sitz bath function, the spray nozzle 214 may spray water to form the spray water stream 215 before the sitz bath nozzles 211 and 211' dispense water, such that stress on the anus of the user may be reduced.

Here, the spray nozzle 214 may be formed between the plurality of sitz bath nozzles 211 and 211'. In detail, the spray nozzle 214 may be formed between the first sitz bath nozzle 211 and the second sitz bath nozzle 211'.

The connector 220 may be installed in an end portion of the sitz bath cylinder 210 to connect the first and second internal stream paths 216*a* and 216*b* to a connection hose (not illustrated) supplying water from a water resource. In detail, the connector 220 may include a first connection unit 221*a* connecting the first internal stream path 216*a* to the connection hose (not illustrated) and a second connection unit 221*b* connecting the second internal stream path 216*b* to the connection hose (not illustrated).

Figure 10:
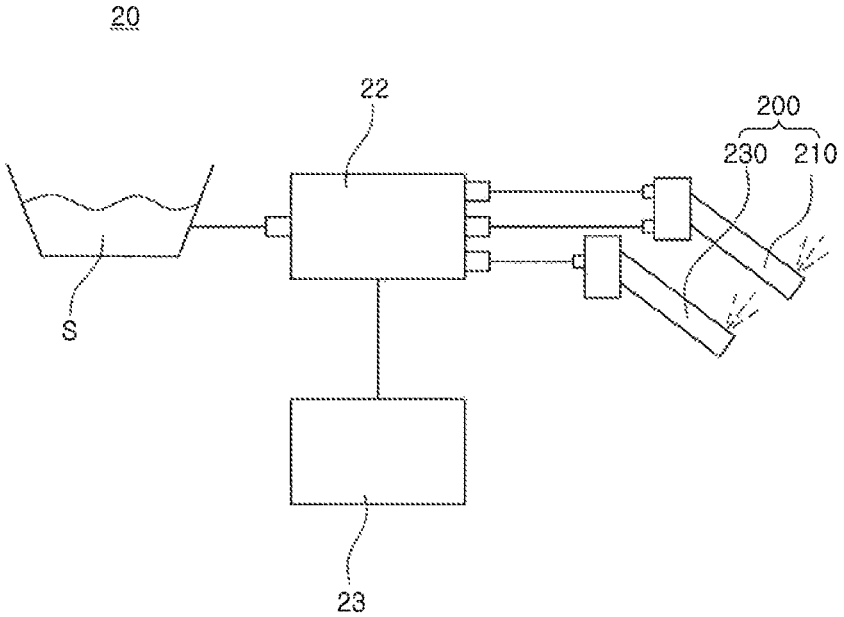
FIG. 10 is a view schematically illustrating a configuration of a bidet including the nozzle assembly according to the second exemplary embodiment of the present disclosure.

FIG. 10 is a view schematically illustrating a configuration of a bidet 20 including the nozzle assembly 200 according to the second exemplary embodiment of the present disclosure.

Referring to FIG. 10, the nozzle assembly 200 according to the second exemplary embodiment of the present disclosure may further include a cleansing cylinder 230 dispensing water to the genitals and anus of a user. In addition, the bidet 20 including the nozzle assembly 200 according to the second exemplary embodiment of the present disclosure may include the nozzle assembly 200, a stream path changing device 22 determining a cylinder among the sitz bath cylinder 210 and the cleansing cylinder 230 to dispense water supplied by a water resource S, and a control unit 23 controlling the stream path changing device 22.

The cleansing cylinder 230 may be installed to dispense water to the genitals or the anus of the user, and the genitals or the anus of the user may be washed as water is dispensed by the cleansing cylinder 230 after the user relieves himself or herself.

The stream path changing device 22 may be installed between the water resource S and the nozzle assembly 200 and determine a cylinder among the sitz bath cylinder 210 and the cleansing cylinder 230 to supply water from the water resource S.

In addition, the stream path changing device 22 may determine whether the water from the water resource S is supplied through the first internal stream path 216*a* to the sitz bath nozzles 211 and 211' to dispense the water, or is supplied through the second internal stream path 216*b* to the spray nozzle 214 to dispense the water.

In detail, when the user selects the sitz bath function, water is dispensed through the spray nozzle 214 to form the spray water stream 215 at an early stage of the sitz bath function, such that the stress on the anus of the user may be relieved. Then, after a predetermined time passes, water is dispensed through the sitz bath nozzles 211 and 211' to form the fountain-like water stream, and the anus of the user contacts the fountain-like water stream, such that the clinical effect of the sitz bath may be brought about.

Here, since water is not dispensed directly to the anus, stimulation to the anus may be significantly reduced, and stress on the anus may not occur, such that pressure inside the anus may be decreased.

The control unit 23 may determine the stream path as described above.

The invention claimed is:

1. A nozzle assembly, comprising:

a plurality of sitz bath nozzles dispensing jets of water, wherein a plurality of water streams formed by the jets of water dispensed by the plurality of sitz bath nozzles contact each other at a water contact point to form fountain-type water streams, wherein the water contact point is formed at an apex point of the plurality of water streams or at a point at which the plurality of water streams fall downwardly after reaching the apex point.

2. The nozzle assembly of claim 1, wherein the water contact point is positioned above the plurality of sitz bath nozzles.

3. The nozzle assembly of claim 2, wherein the plurality of sitz bath nozzles and the water contact point are positioned on a single virtual plane.

4. The nozzle assembly of claim 3, wherein the virtual plane is perpendicular to a horizontal plane.

5. The nozzle assembly of claim 1, wherein the plurality of sitz bath nozzles are provided as a pair of sitz bath nozzles, respectively included in each of a pair of sitz bath cylinders.

6. The nozzle assembly of claim 5, wherein the virtual plane on which the pair of sitz bath nozzles and the water contact point are positioned is perpendicular to a horizontal plane.

7. The nozzle assembly of claim 5, wherein the water streams dispensed by the pair of sitz bath nozzles have equal water jet angles with respect to an axis perpendicular to a horizontal plane.

8. The nozzle assembly of claim 7, wherein the water jet angles range from 2.5 to 3.5 degrees.

9. The nozzle assembly of claim 5, wherein the pair of sitz bath cylinders are disposed to be spaced apart from each other by 45 mm to 55 mm.

10. The nozzle assembly of claim 5, wherein the pair of sitz bath nozzles respectively dispense 0.4 to 1.6 liters of water per minute.

11. The nozzle assembly of claim 1, wherein the plurality of sitz bath nozzles are included in a single sitz bath cylinder.

12. The nozzle assembly of claim 11, further comprising a spray nozzle formed in the sitz bath cylinder to form spray water streams.

13. The nozzle assembly of claim 12, wherein the spray nozzle is formed between the plurality of sitz bath nozzles.

14. The nozzle assembly of claim 11, wherein the plurality of sitz bath nozzles include a first sitz bath nozzle formed in the sitz bath cylinder and a second sitz bath nozzle formed in the sitz bath cylinder to be spaced from the first sitz bath nozzle in a rearward direction.

15. The nozzle assembly of claim 14, wherein the first sitz bath nozzle dispenses water in a direction of the second sitz bath nozzle, and an angle formed by the dispensed water with respect to a plane of the sitz bath cylinder may be in a range of 60 to 80 degrees; and the second sitz bath nozzle dispenses water so that the water contacts a water stream formed by the water dispensed by the first sitz bath nozzle at the water contact point.

16. The nozzle assembly of claim 1, further comprising a cleansing cylinder dispensing water to the genitals and anus.

17. A bidet, comprising:

the nozzle assembly of claim 16;

a stream path changing device able to determine a cylinder to dispense water among the sitz bath cylinder and the cleansing cylinder; and a control unit controlling the stream path changing device.

18. The bidet of claim 17, wherein the nozzle assembly further comprises a spray nozzle forming spray water streams, and the stream path changing device determines a nozzle to dispense water among the sitz bath nozzle and the spray nozzle.

19. The bidet of claim 18, wherein when a user selects a sitz bath function, the control unit controls the stream path changing device so that water is dispensed through the spray nozzle at an early stage of the sitz bath function, and when a predetermined time passes, the control unit controls the stream path changing device so that water is dispensed through the sitz bath nozzle.

20. The bidet of claim 1, wherein the apex point is defined at an apex of a parabola formed by each of the plurality of water streams.

* * * * *